United States Patent [19]

Varlet

[11] Patent Number: 4,779,816

[45] Date of Patent: Oct. 25, 1988

[54] CORD WINDER

[76] Inventor: Marc F. Varlet, 8 Rue des Ecoles, 56410 Etel, France

[21] Appl. No.: 918,309

[22] Filed: Oct. 14, 1986

[30] Foreign Application Priority Data

Oct. 11, 1985 [FR] France ..... 85 15372

[51] Int. Cl.[4] ..... B65H 75/40

[52] U.S. Cl. ..... 242/96; 24/71.3

[58] Field of Search ..... 242/77, 77.3, 84.2 J, 242/85.1, 96; 24/71.1, 71.2, 71.3

[56] References Cited

U.S. PATENT DOCUMENTS

| | | | |
|---|---|---|---|
| 605,607 | 6/1898 | Koch | 242/85.1 |
| 933,189 | 9/1909 | Linnell | 242/85.1 |
| 2,038,478 | 4/1936 | Coombs | 242/96 |
| 2,683,937 | 7/1954 | Criswell | 242/85.1 X |
| 3,252,189 | 5/1966 | Kanneworff et al. | 24/71.3 |
| 3,626,495 | 12/1971 | Bastian | 242/85.1 |
| 3,817,471 | 6/1974 | Finneman | 242/85.1 |
| 4,123,012 | 10/1978 | Hough | 242/85.1 |
| 4,261,529 | 4/1981 | Sandberg et al. | 242/85.1 |

*Primary Examiner*—Stuart S. Levy
*Assistant Examiner*—Joseph J. Hail, III
*Attorney, Agent, or Firm*—Lowe, Price, LeBlanc, Becker & Shur

[57] ABSTRACT

A cord winder for reducing cord length and for cord storage includes a body (1) having at each end thereof a cord receiving well (2) (3), and two spring hooks (4) (5). Two holes (6) (7) in the body in proximity to one of the wells are dimensioned to receive the cord when the winder is used to effectively shorten the length of one end of the cord thereof. Among the applications of the invention are putting curtain cords out of children's reach, storing halyards on boats and for winding electric extension cords.

16 Claims, 1 Drawing Sheet

CORD WINDER

FIELD OF THE INVENTION

This invention relates to cord winders and more particularly to a cord winder including a pair of oppositely disposed cord receiving wells, each in proximity with a hook having an opening that is normally closed by a leaf spring.

BACKGROUND OF THE INVENTION AND DISCUSSION OF THE PRIOR ART

Dangling cords used for operating curtains or venetian blinds, for example, in a home, present a strangulation danger for young children. Known curtain and venetian blind operating devices for cord winding, including bobbins or coils and cleats, have not been designed with consideration of this problem. They do not have a safety feature to prevent untimely cord unwinding. Alternatively, cord pulleys must be affixed to a wall.

It is an object of the present invention to provide a cord winder to reduce cord length without risk of untimely cord unwinding.

Another object is to provide a new and improved cord winder, capable of effectively shortening the length of one end or the center of a cord.

SUMMARY OF THE INVENTION

The present invention includes a plate including a pair of oppositely disposed cord receiving wells. In proximity with each well is a hook forming an opening that is normally closed by a leaf spring. On the body of the plate in proximity with one of the wells are a pair of openings through which the cord extends.

The above and still further objects, features and advantages of the present invention will become apparent upon consideration of the following detailed description of a specific embodiment thereof, especially when taken in conjunction with the accompanying drawing.

DESCRIPTION OF THE PREFERRED EMBODIMENT

Figure 1:
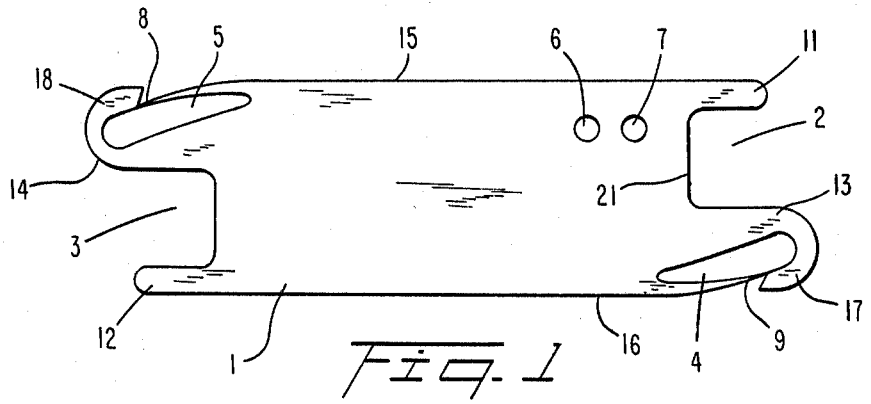
FIG. 1 is a plan view of a cord winder in accordance with a preferred embodiment of the present invention.
Figure 2:
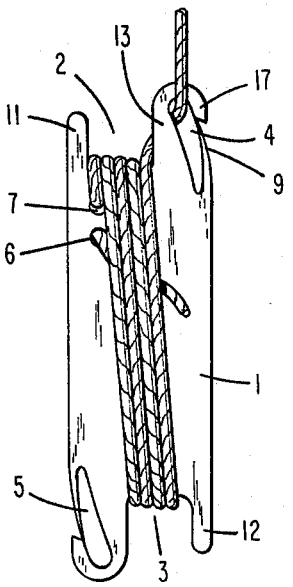
FIG. 2 is a side view of the winder illustrated in FIG. 1, as used to reduce the length of an end of the cord.
Figure 3:
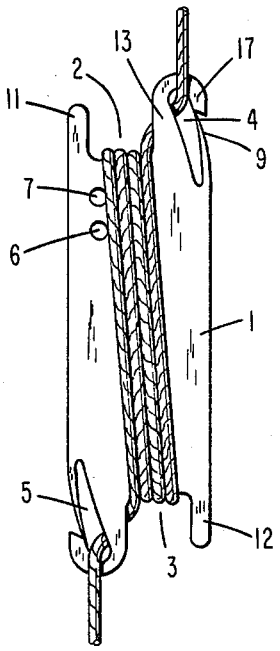
FIG. 3 is a side view of the winder illustrated in FIG. 1, as used to reduce the length of the middle of the cord.

Reference is now made to FIGS. 1–3 wherein a cord winder is illustrated as a one piece, integral, plastic injection molded structure shaped as a plate, i.e., a flat body having oppositely disposed cord receiving wells 2 and 3 at each end. Wells 2 and 3 are formed by flanges 11 and 12 as well as abutments 13 and 14 that are aligned with and extend from opposite edges 15 and 16 of plate 1 and are on opposite faces of the plate. Abutments 13 and 14 are disposed on the sides of wells 2 and 3 opposite from flanges 11 and 12, respectively so they are on opposite corners of plate 1. At the ends of abutments 14 and 15 are hooks 17 and 18 that respectively extend beyond the ends of flanges 11 and 12. Hooks 17 and 18 are dimensioned and positioned to form cord receiving cavities 4 and 5, respectively closed by leaf spring hooks 8 and 9. Hooks 8 and 9 are respectively aligned with edges 15 and 16 to project away from the main body portion of plate 1 into engagement with interior surfaces of hooks 18 and 19. The entrance to each of cavities 4 and 5 through hooks 18 and 17 is a dihedral angle of less than 90 degrees to facilitate insertion of the cord into the cavities. Holes 6 and 7 in the body of plate 1 in proximity of base 21 of well 2 are used to retain the extremity of a cord to avoid cord slipping.

To shorten one end of a cord, the cord is wound as illustrated in FIG. 2 so that the shortened end extends through hole 6 along a first face (not shown) of plate 1 then back through hole 7. From hole 7, the cord extends along a second face of plate 1 into well 2, thence along the first face into well 3. The cord is wrapped on the first and second faces of plate 1 between wells 2 and 3 until the required cord length has been taken up, with the free end of the cord extending out of well 2 against the wall of abutment 13 forming the well. The portion of the cord extending out of well 2 is inserted into cavity 4 by pushing that portion of the cord against spring 9 to momentarily open the closure which normally subsists between the spring and hook 17. None of the cord need be inserted into cavity 5 for this application.

To shorten the center of a cord, the center of the cord is wound between wells 2 and 3 along the first and second faces of body 1 without passing through holes 6 and 7, as illustrated in FIG. 3. The portions of the cord extending out of wells 2 and 3 are respectively inserted into cavities 4 and 5 by pushing those portions of the cord against springs 8 and 9 to open the closures which normally subsist between the springs and hooks 17 and 18.

This product being a one piece, integral construction permits easy industrial manufacturing by molded plastic injection of the structure including leaf springs 8 and 9.

What is claimed is:

1. A cord winder for enabling one end of a cord to be effectively shortened and for enabling a center portion of a cord to be effectively shortened comprising a body having a well in each of first and second opposite ends thereof, each of said wells being dimensioned and having a geometry enabling several turns of the cord to be wound therein, first and second hooks respectively forming first and second cavities on first and second edges of the body extending between the opposite ends, said first and second cavities being respectively at the ends of the first and second edges in proximity with said first and second wells, said cavities being dimensioned to receive the cord, each of the first and second hooks having a first portion in proximity to the first and second wells and a second portion remote from the first and second wells, respectively, the first portion extending longitudinally away from the body, means for connecting the first and the second portions together at a region remote form the body, the second portion extending from the region longitudinally toward the body, first and second leaf springs positioned on the body to extend longitudinally away from the body toward the regions and biased to normally engage inner surfaces of the second portions of the first and second hooks for selectively opening the first and second cavities, respectively, and first and second holes dimensioned to receive the cord extending between opposite sides of the body between the wells, the holes, cavities and wells being positioned so that (a) one end of the cord can extend from one side of the body through one of the holes to a second side of the body thence through the other hole into the first well and is windable on the body into the second well and thence into the first and second wells and from the first well into the first cavity and (b) the center of the cord is windable on the body into the first and second wells and first and second opposite extensions from the center of the cord are respectively extendible into the first and second cavities, said body, hooks and leaf springs being of one-piece construction of the same material.

2. The cord winder of claim 1 wherein the first and second cavities are formed in first and second abutments on diametrically opposed corners of the body so that the first and second abutments include sides substantially aligned with the first and second edges and first and second sides of the body, the first and second abutments including an edge forming a first wall of the first and second wells, respectively.

3. The cord winder of claim 2 further including first and second flanges projecting from diametrically opposed corners of the body along the first and second edges, respectively, the first and second flanges including an edge forming a second wall of the first and second wells, respectively.

4. The cord winder of claim 3 wherein the first hole is displaced from said first end by an amount different from the displacement of the second hole from said first end.

5. The cord winder of claim 4 wherein the first and second holes are displaced from said first end by an amount less than they are displaced from said second end.

6. The cord winder of claim 1 wherein the first and second cavities are formed in first and second abutments on diametrically opposed corners of the body so that the first and second abutments include sides substantially aligned with the first and second edges and first and second sides of the body, the first and second abutments including an edge forming a first wall of the first and second wells, respectively.

7. The cord winder of claim 6 further including first and second flanges projecting from diametrically opposed corners of the body along the first and second edges, respectively, the first and second flanges including an edge forming a second wall of the first and second wells, respectively.

8. The cord winder of claim 6 wherein the first hole is displaced from said first end by an amount different from the displacement of the second hole from said first end.

9. The cord winder of claim 8 wherein the first and second holes are displaced from said first end by an amount less than they are displaced from said second end.

10. A cord winder for enabling one end of a cord to be effectively shortened comprising a body having first and second wells in first and second opposite ends thereof, respectively, each of said wells being dimensioned and having a geometry enabling several turns of the cord to be wound therein, a hook forming a cavity on an edge of the body extending between the opposite ends, said cavity being at the end of the edge in proximity with said first well, said cavity being dimensioned to receive the cord, said hook having a first portion in proximity of the first well and a second portion remote from said first well, the first portion extending longitudinally away from the body, means for connecting the first and the second portions together at a region remote from the body, the second portion extending from the region longitudinally toward the body, a leaf spring positioned on the body to extend longitudinally away from the body toward the region and biased to normally engage an inner surface of the second portion of the hook for selectively opening the cavity, and first and second holes dimensioned to receive the cord extending between opposite sides of the body between the wells, the holes, cavity and wells being positioned so that one end of the cord can extend from one side of the body through one of the holes to a second side of the body thence through the other hole into the first well and is windable on the body into the second well and thence into the first and second wells and form the first well into the cavity, said body, hook and leaf spring being of one-piece construction of the same material.

11. The cord winder of claim 10 wherein the first hole is displaced from said first end by an amount different from the displacement of the second hole from said first end.

12. The cord winder of claim 11 wherein the first and second holes are displaced from said first end by an amount less than they are displaced from said second ends.

13. A cord winder for enabling a center portion of a cord to be effectively shortened comprising a body having first and second wells in first and second opposite ends thereof, respectively, each of said wells being dimensioned and having a geometry enabling several turns of the cord to be wound therein, first and second hooks respectively forming first and second cavities on first and second edges of the body extending between the opposite ends, said first and second cavities being respectively at the ends of the first and second edges in proximity with said first and second wells, said cavities being dimensioned to receive the cord, each of the first and second hooks having a first portion in proximity to the first and second wells and a second portion remote from the first and second wells, respectively, the first portion extending longitudinally away from the body, means for connecting the first and the second portions together at a region remote from the body, the second portion extending from the region longitudinally toward the body, first and second leaf springs positioned on the body to extend longitudinally away from the body toward the regions and biased to normally engage inner surface of the second portions of the first and second hooks for selectively opening the first and second cavities, respectively, the cavities and wells being positioned so that the center of the cord is windable on the body into the first and second wells and first and second opposite extensions from the center of the cord are respectively extendible into the first and second cavities through openings closed by the first and second leaf springs, the body, hooks and leaf springs being of one-piece construction of the same material.

14. The cord winder of claim 13 wherein the first and second cavities are formed in first and second abutments on diametrically opposed corners of the body so that the first and second abutments include sides substantially aligned with the first and second edges on first and second sides of the body, the first and second abutments including an edge forming a first wall of the first and second wells, respectively.

15. The cord winder of claim 14 further including first and second flanges projecting from the diametrically opposed corners of the body along the first and second edges, respectively, the first and second flanges including an edge forming a second wall of the first and second wells, respectively.

16. A cord winder for enabling a center portion of a cord to be effectively shortened comprising a body having first and second wells in first and second opposite ends thereof, respectively, each of said wells being dimensioned and having a geometry enabling several turns of the cord to be wound therein, first and second hooks respectively forming first and second cavities on first and second edges of the body extending between the opposite ends, said first and second cavities being respectively at the ends of the first and second edges in proximity with said first and second wells, said cavities being dimensioned to receive the cord, each of the first and second hooks having a first portion in proximity to the first and second wells and a second portion remote from the first and second wells, respectively, the first portion extending longitudinally away from the body, means for connecting the first and the second portions together at a region remote from the body, the second portion extending from the region longitudinally toward the body, first and second leaf springs positioned on the body to extend longitudinally away from the body toward the regions and biased to normally engage inner surfaces of the second portions of the first and second hooks for selectively opening the first and second cavities, respectively, the cavities and wells being positioned so that the center of the cord is windable on the body into the first and second wells and first and second opposite extensions from the center of the cord are respectively extendible into the first and second cavities through openings closed by the first and second leaf springs, said body, hooks and leaf springs being of one-piece construction of the same material

* * * * *